US010646048B2

(12) United States Patent
Tillner

(10) Patent No.: US 10,646,048 B2
(45) Date of Patent: May 12, 2020

(54) COVER FOR A MATTRESS OR A CUSHION AS WELL AS A MATTRESS OR CUSHION WITH SUCH A COVER

(71) Applicant: OKE GROUP GMBH, Hoerstel (DE)

(72) Inventor: Thomas Tillner, Osnabrück (DE)

(73) Assignee: OKE GROUP GMBH, Hoerstel (DE)

( * ) Notice: Subject to any disclaimer, the term of this patent is extended or adjusted under 35 U.S.C. 154(b) by 197 days.

(21) Appl. No.: 15/740,497

(22) PCT Filed: Feb. 20, 2017

(86) PCT No.: PCT/EP2017/025031

§ 371 (c)(1),
(2) Date: Dec. 28, 2017

(87) PCT Pub. No.: WO2018/001566

PCT Pub. Date: Jan. 4, 2018

(65) Prior Publication Data

US 2018/0242754 A1 Aug. 30, 2018

(30) Foreign Application Priority Data

Jun. 30, 2016 (DE) ..... 10 2016 007 909
Jul. 27, 2016 (DE) ..... 10 2016 009 065

(51) Int. Cl.
*A47C 27/045* (2006.01)
*A47C 27/16* (2006.01)
(Continued)

(52) U.S. Cl.
CPC ..... *A47C 27/0453* (2013.01); *A47C 7/20* (2013.01); *A47C 23/06* (2013.01); *A47C 23/063* (2013.01);
(Continued)

(58) Field of Classification Search
CPC ..... A47C 31/10; A47C 27/065; A47C 27/05; A47C 23/063; A47C 31/105; A47C 23/06; A47C 7/20; A47C 27/16; A47C 23/061
See application file for complete search history.

(56) References Cited

U.S. PATENT DOCUMENTS

2004/0148702 A1* 8/2004 Husler ..... A47C 23/06 5/236.1

FOREIGN PATENT DOCUMENTS

CH 518080 A 1/1972
CH 695 083 A5 12/2005
(Continued)

OTHER PUBLICATIONS

Espacenet Translation of DE-4202317-A1 (Year: 1993).*
Espacenet Translation of EP-2865296-A1 (Year: 2014).*

*Primary Examiner* — Nicholas F Polito
*Assistant Examiner* — James T Coble
(74) *Attorney, Agent, or Firm* — David S. Safran; Roberts Calderon Safran & Cole, P.C.

(57) ABSTRACT

A cover (8) for a mattress (6) or a cushion (3) of a piece of furniture (1) with a utilized side (10) and a back side (11), wherein on the back side (11) there is a receiving device for bottom spring cushioning (12) which has spring strips (15), wherein at least one spring strip (15) is made of a fiber-reinforced plastic material with a preferably pultruded fiber core (16) and a plastic jacket (17) which surrounds the fiber core (16). It is provided that on opposite sides of the jacket (17) one jacket side (18) at a time sticks out for an enlarged support surface of the spring strip (15).

18 Claims, 10 Drawing Sheets

(51) Int. Cl.

| | |
|---|---|
| ***A47C 27/05*** | (2006.01) |
| ***A47C 27/06*** | (2006.01) |
| ***B68G 11/06*** | (2006.01) |
| ***A47C 23/06*** | (2006.01) |
| ***A47C 7/20*** | (2006.01) |
| ***A47C 31/10*** | (2006.01) |

(52) U.S. Cl.
CPC ..... *A47C 27/05* (2013.01); *A47C 27/065* (2013.01); *A47C 27/16* (2013.01); *A47C 31/10* (2013.01); *A47C 31/105* (2013.01); *B68G 11/06* (2013.01)

(56) References Cited

FOREIGN PATENT DOCUMENTS

| | | | |
|---|---|---|---|
| DE | 1253877 | B | 11/1967 |
| DE | 42 02 317 | A1 | 8/1993 |
| DE | 10 2012 011 291 | A1 | 5/2014 |
| EP | 1 512 348 | B1 | 10/2004 |
| EP | 2 865 296 | A1 | 4/2015 |
| WO | 2014/075789 | A1 | 5/2014 |

* cited by examiner

COVER FOR A MATTRESS OR A CUSHION AS WELL AS A MATTRESS OR CUSHION WITH SUCH A COVER

BACKGROUND OF THE INVENTION

Field of the Invention

The invention relates to a cover for a mattress or a cushion of a piece of furniture, with a utilized side and a back side, wherein on the back side there is a receiving device for bottom spring cushioning which has spring strips, wherein the spring strip is made of a fiber-reinforced plastic material with a preferably pultruded fiber core and a plastic jacket which surrounds the fiber core. Furthermore, the invention relates to a mattress or a cushion for a seat part or a backrest of a piece of furniture, in particular a piece of upholstered furniture, with a cover of the aforementioned type. Finally, the invention relates to a piece of furniture with a mattress or a cushion of the aforementioned type.

Description of Related Art

The so-called cushion structure of a piece of furniture, in particular of a piece of upholstered furniture, describes the individual layers and the materials used which are used in the upholstery of upholstered furniture, in particular sitting and reclining furniture. The most common materials are foam, spring core, spring insert, cushion padding and insulating felt. The bottom termination of the cushion structure is formed by the so-called bottom spring cushioning which bears the aforementioned materials.

Conventional upholstered furniture backings, which are also called bottom spring cushioning or cushion base, are rubber belts which are relatively soft, zigzag springs which have medium hardness, and textile belts or wood spring strips which are considered hard. Wood spring strips correspond to the lath grid of beds. Fundamentally, the backing can also be a simple wood slab which generally consists of a hard fiber material which enables the least sinking depth since it does not yield at all.

In the choice of the cushion structure among others the later yielding of the upholstery plays a part. A soft sitting surface which enables deep sitting generally never has a wood spring strip as the bottom spring cushioning, but as top cushioning a foam block and as bottom spring cushioning conventionally rubber belts and also zigzag springs which have been tensioned over a long distance. Furthermore, pocket springs which can be used above the cushion base can also be used. The pocket springs can also replace part of the plastic of the top cushioning. Pocket springs are used in particular in sitting furniture and mattresses.

Conversely firm cushioning conventionally has a spring insert on a foam block as the top cushioning and as the bottom spring cushioning zigzag springs tensioned over a short distance, textile belts, wood spring strips or a wood slab. Here the sinking behavior is then correspondingly low.

The most frequently used bottom spring cushioning of upholstered furniture is the (steel) zigzag spring which is also called a no-sag spring. Zigzag springs are used as the elastic foundation both for flat cushions and also for tall upholstery with spring core. They are used as bottom spring cushioning of seats and also in backrest upholstery. Zigzag springs are generally produced in roll form as a ring with a total length of roughly 30 m. While the width of the zigzag springs is always uniform and need not be taken into account, the size of the wire thickness by which the hardness or softness of the later upholstery is influenced should always be considered. Thin wire thicknesses (for example roughly 2.8 mm) are used solely for back upholstery. Seat upholstery requires a foundation with thicker zigzag springs with roughly 3.6 or 4.0 mm wire thickness.

For installation in furniture, as the first working step the number of zigzag springs needed which run next to one another from the front to the rear edge is established. The distances between the springs are generally between 70 mm and 135 mm. On this basis, for a frame of 40 cm width four zigzag springs are required. This distance describes the distance of the center of the spring to the center of the next spring, therefore not the actual intermediate space from spring to spring.

The next step is the measurement of the required length of the zigzag springs. This can be done most easily with a so-called folding rule since the springs are to curve slightly and a foot rule with a gentle arc of the rear and front edge can be employed. The ascertained amount is cut off from the zigzag spring ring in a corresponding number of pieces by bolt cutter. Since the cut arcs always point in the direction in which the zigzag springs run due to the continuous fabrication of the product, these ends must be bent with a special bending device such that the outer end arcs point to the inside, therefore in the direction of the later cushion base. This is necessary since the springs otherwise can slip out of their holders (clips) when highly loaded. The zigzag springs are first attached to the rear edge of the frame. To do this, plastic or metal clips, also called hinges, are tacked on at the corresponding positions or quite classically fastened with large pin belts and/or harpoon nails.

The prior art discloses different clips or clip strands with several clips with fixed intervals. Some versions are tacked on once or twice, other are first tacked on only once, then the spring is hung in the clip, the top part of the clip is bent out and closed with two additional tacker clamps.

Since on the forward edge the individual hinges are also tapped at the correct positions, the zigzag springs can be hung with high tension. There are various aids and special tools for this strenuous work. Traditionally, in the prior art a tear-proof loop is used which is threaded into the forward curve of the spring. Then the spring is pulled lengthwise over the loop of the spring enough to be able to hang in its clip on the front edge. Then all zigzag springs are hung in this way. It may be necessary for a second individual to hold the cushion frame in this step on the bottom since light frames can slip and tilt under extreme tensile loading until the spring is hung.

Ideally, zigzag springs always lie in pairs symmetrically next to one another. For two adjacent springs the closed and open curves are respectively opposite one another. This enables final joining of the different springs with stable rubber rings or with the repeatedly transversely running tying of the zigzag springs through using threads so that nonuniform, rather spot loading of the later cushion on the cushion base is distributed over a larger area. For tying-through, on one side edge a rather long filament thread is attached and routed to the opposite edge, wherein each spring is knotted in and the end of the thread is attached on the opposite side.

This is followed by covering of the zigzag spring base with heavy tensioning cords or spring cords. The latter is cut off accordingly and stitched over. But since not all upholstered furniture is closed on its bottom with tensioning material and a look under the finished article of furniture should offer a neat work picture, the cord, during subsequent tapping, is driven in upward. If front and rear posts should be in the way in covering with spring cords, the cords must be cut simply or in a Y-shape before tapping in these corners.

Altogether, the attachment of bottom spring cushioning with zigzag springs in furniture is very expensive. But the fastening of Pullmaflex mats or pocket spring cores in upholstered furniture and mattresses is often also problematic.

Belt strips or cushion belts are used mainly as cushion backings for seat and backrest upholstering, but are mainly used in backrests since they tend to be more elastic than the above described zigzag springs. Belts are also used for exotically shaped components with radii which can only be poorly supported with zigzag springs, or in upholstered furniture in which especially casual ease of sitting is desirable.

Belts consist of different materials with different elasticity. To install the bottom spring cushioning in classic upholstery as well as in spring core, flat and foam upholstering, generally inelastic textile belts are used which generally consist of hemp or jute. To install elastic back and seat upholstery generally woven rubber or solid rubber belts are used in strip widths between 30 and 80 mm, up to 150 mm and with different elasticity. For the back side region generally very elastic rubber strips are used and for the seat region less elastic belts.

Also, when using cushion belts, belt widths and elasticities are first computed and then measured and marked off for each seat. The cushion belts are fastened on the base frame of the article of furniture then as a belt base (less elastic), rubber belt strip (elastic) or rubber fabric (for closed cushion base). The cushion belts are not simply fastened next to one another, but are woven horizontally and vertically to a belt base. They are tensioned crosswise and fastened with a tacker or special belt nails (belt pins). Aids in the demanding manual tensioning and fastening are for example belt tensioners. On the top edge they have steel tips which are inserted through the belt in the tensioning process. On the other end of the tool there is a non-skid support which is placed on the edge of the wood frame. In this way the degree of tensioning can be estimated and the belts can be fastened with a tension which is as uniform as possible.

The attachment of cushion belts is also relatively expensive in practice.

Furthermore, wood spring strips are used as bottom spring cushioning, though generally only for furniture with long surfaces, in particular beds and in upholstered furniture with an integrated bed function. Here the individual wood spring strips are located parallel and spaced apart from one another and are held either on a frame or are joined to one another generally via two fabric belts which run transversely to the spring strips. The spacing and the relative arrangement of the individual spring strips to one another are ensured via the frame and the fabric belts. This construction with an outer frame is comparatively expensive and takes up a relatively large amount of space; this makes warehousing and transport difficult. But holding the wood spring strips together via belts is also known. This yields a very simple structure and such a cushion base is also rollable. But the aforementioned cushion base structure with the belts which run transversely to the wood spring strips has the defect that in this case a defined location of the individual wood spring strips to one another in the installed state can hardly be permanently achieved.

In the aforementioned cushion base structure, the spring strips generally consist of wood. In order to be able to achieve a high bearing capacity, the wood spring strips must have a preliminary curvature towards the middle. At different widths of the cushion base this leads to wood spring strips of different length and thus different curvature having to be stocked.

Generally, on a cushion base of the aforementioned type there is a cladding protector as an intermediate layer between the cladding (upholstery) and the cushion base. This cladding protector is generally used to protect the bottom of the cladding.

German Patent Application DE 1 253 877 B discloses a cover of a mattress of the initially mentioned type, wherein on the back side there is a receiving device for bottom spring cushioning having spring strips. The spring strips are made as steel or glass fiber rods which are surrounded by a corrosion- and noise-inhibiting wrapping of plastic or rubber. In the known cover it is such that there are a plurality of pockets, wherein one pocket is able to accommodate one or even several rods. Individual pockets can also remain unfilled without the incorporation of rods. By removing or shifting the rods the cushioning comfort of known mattresses can be matched accordingly to the respective requirements. But in the known mattresses it is such that the spring strips of steel or glass fibers which are used there have comparatively high stiffness even at a small diameter. This results in that the spacing between adjacent spring strips must be chosen to be comparatively great in order to avoid overly high stiffness. Based on the comparatively large spacing between adjacent spring strips however the support surface for the actual mattress body is comparatively small. At sites on which there are no spring strips, the mattress body when loaded pancakes comparatively dramatically; this adversely affects comfortable sitting and reclining on the mattress.

German Patent Application DE 42 02 317 A1 discloses a cover in which there are wooden sheets, plastic sheets or metal sheets as spring strips.

European Patent Application EP 1 512 348 B1 discloses a mattress with a cover which on its bottom has pockets for accommodating lath grid elements. These components consist of a solid material.

Swiss Patent Application CH 695 083 A5 relative to a reclining or sitting underlayer which has a cover which on its back likewise has a receiving device for laths consisting of a solid material as spring strips of bottom spring cushioning.

German Patent Application DE 10 2012 022 291 A1 and corresponding International Patent Application Publication WO2014075789 relate to a mattress with an integrated lath grid. The execution of the laths of the lath grid is not described in particular in this document.

SUMMARY OF THE INVENTION

The object of the invention at this point is to make available a cover of the initially mentioned type in which the bottom spring cushioning has spring strips which have been produced as easily and economically as possible and offers good spring cushioning comfort.

In accordance with the invention, in a cover of the initially named type which can be both a mattress cover and also a cushion cover, it is provided that on opposite sides of the jacket one jacket side at a time sticks out for an enlarged support surface of the spring strips. The mattress in accordance with the invention or the cushion in accordance with the invention as part of a piece of furniture accordingly have a cover of the type in accordance with the invention with bottom spring cushioning. In addition, it is pointed out that the mattress is intended in particular for a bed or sofa bed and that such a bed or sofa bed can ultimately be viewed in the same manner as furniture or upholstered furniture, such as an armchair, a sofa or the like.

It is especially advantageous with respect to good spring cushioning comfort and easily and economically produced spring strips that the spring strips are produced from a fiber-reinforced plastic material. The preferably pultruded fiber core, in particular glass fiber core or GFK core, therefore glass fiber reinforced plastic core, is surrounded by a thermoplastic matrix. The fiber core is used as a reinforcing element and largely defines the elasticity of the spring strips. It can be made as a hollow tube or also as a filled strand. Depending on the required elasticity, it has a larger or smaller diameter. The elasticity can also be influenced by the cross sectional shape. Here, the shape of the fiber core is not limited to round or elliptical cross sections. Angular, in particular rectangular cross sections, are also possible. Due to the fiber core and the jacket which surrounds the fiber core, relatively thin but still very supportive spring strips can be made available which, differently from wooden spring strips, are made straight and not curved beforehand. The spring strips which are made straight and not curved beforehand ultimately facilitate the insertion of the spring strips into the pockets of the receiving device.

Furthermore, it is provided in accordance with the invention that one jacket side at a time sticks out from the jacket of the spring strip which surrounds the fiber core laterally on opposite sides. Here, the width of the jacket side is preferably greater than the diameter of the fiber core, in particular by at least 1.5 times, furthermore preferably by at least 2 times, and in particular by 2.4 to 3.0 times the diameter of the fiber core. In addition, in this connection though it is preferred that the maximum thickness of the jacket side is less than the diameter of the fiber core, preferably by at least 2 times, furthermore preferably by at least 3 times, and in particular by 4 to 8 times the diameter of the fiber core. As a result this yields, viewed in cross section, a thickened middle region with a fiber core and casing region which is joined laterally on opposite sides to one jacket side at a time with a smaller thickness. But the jacket need not necessarily be thicker than the jacket side. Fundamentally, the jacket and the jacket side can also have the same thickness.

Constructively with respect to the cover there is a corresponding receiving device for positioning, holding and/or fastening of the bottom spring cushioning on the back of the cover. If the cover is applied to a corresponding core of the mattress or of the cushion, joint manipulation of the mattress or the cushion together with the bottom spring cushioning takes place. As a result, the structure of a piece of furniture with a mattress in accordance with the invention and a cushion in accordance with the invention is greatly simplified. In particular, in the configuration in accordance with the invention it is no longer necessary to mount or fasten the bottom spring cushioning on the piece of furniture itself. Although due to the integration of the bottom spring cushioning into the cover there is no direct fastening to the piece of furniture, there is still a very defined location of the bottom spring cushioning to the mattress or to the cushion.

Another advantage arises in the configuration in accordance with the invention for the final user in that after removing a mattress or a cushion from the furniture base the bottom underneath the piece of furniture becomes immediately accessible; this is not the case in the prior art since there after removing the mattress or the cushion from the furniture foundation there is still generally the bottom spring cushioning. Thus in the prior art the bottom is generally not easily accessible underneath the mattress or the cushion and can only be cleaned with difficulty.

Fundamentally, it is possible to provide the receiving device for the bottom spring cushioning on the inner side of the back side of the cover, which inner side faces the core of the mattress or of the cushion. But it is preferable for the receiving device to be the outer side of the back side of the cover. In this way, after putting a cover on the back side of the mattress or the cushion the bottom spring cushioning can be easily inserted into the receiving device and if necessary removed again if this is necessary, for example for cleaning of the cover. The placement and/or fastening of the bottom spring cushioning on the mattress and/or the cushion is thus independent of the actual production of the cover and also of the mattress or the cushion.

Preferably, the receiving device is made as a pocket arrangement which has a plurality of pockets for installation of the spring strips. Preferably there is one pocket per spring strip, wherein the pockets preferably have the same distance from one another. As a result, ultimately on the back side of the cover for the mattress or of the cushion bottom spring cushioning in the form of a lath grid is made with a plurality of spring strips which in particular run parallel to one another. The pocket arrangement which has the pockets ensures that a defined and reliable arrangement of the individual spring strips arises, and not only within the pocket arrangement, but also with respect to the arrangement of the spring strips to the mattress and/or to the cushion. The spring strips need simply be inserted into the pockets which are intended for this purpose. When the individual pockets in terms of cross section correspond at least essentially to the cross sectional dimensions of the spring strip, the spring strips falling out of the pockets when handling the mattress and/or cushion need not be feared. In particular, the pockets can be made in terms of their shape and size with reference to the spring strips such that the spring strips in the state inserted into the pockets are held by frictional resistance therein. In addition, and/or alternatively, it is provided that the spring strips are inserted positively into the individual pockets, positively meaning a captive arrangement of the respective spring strip in the respective pocket. Here the pockets can be closed on the end side, for example sewn shut, or can be closable, for example by means of a button, push button, VELCRO® hook and loop fastener and/or zipper union.

In particular, the aforementioned configuration of the spring strips yields bottom spring cushioning which is integrated into the cover and offers the possibility of rolling up the mattress or even the cushion including the bottom spring cushioning. The pocket arrangement together with the spring strips located in it easily allows the mattress or also a cushion to be vacuumed and then rolled up if necessary. This improves the transportability of the mattress in accordance with the invention and/or the cushion in accordance with the invention; this is of great importance in particular for final customers.

The pocket arrangement as such can have different configurations. In one preferred configuration the pocket arrangement has at least two fastening strips which extend at least essentially over the entire length of the back side of the cover. Here the fastening strips run preferably parallel to one another and/or lengthwise or transversely to the longitudinal axis of the cover. The fastening strips are each permanently joined to the back side via a plurality of connecting sites. Preferably the fastening strips consist of a textile material and are sewn or cemented in particular to the back side of the cover. Between adjacent connecting sites there is one connection-free segment which is made in terms of its dimensions such that it forms a pocket receiver of one pocket for one spring strip. By using at least two fastening strips a pocket then is formed by pocket receivers of the fastening strips, which receivers are opposite one another. The opposing arrangement of the pocket receivers means that with the spring strips inserted they run transversely to the longitudinal direction and in the transverse direction of the cover and when the cover has been pulled on, in the corresponding direction of the mattress or of the cushion.

Preferably, the fastening strips run spaced apart from one another and in particular in the edge region of the outer side. In this embodiment the pocket receivers on the fastening strips each have one through opening for inserting the respective spring strip. In particular, the spring strips whose length corresponds preferably at least essentially to the width of the back side of the cover project over the outer edges of the fastening strips. Then, if necessary, the spring strips can be placed directly on the edges which are opposite one another on the foundation and/or frame of the piece of furniture.

Fundamentally, the projecting length of the spring strips over the fastening strips can also be used if necessary to provide a fastener on the respective end of the spring strip in order to place the respective spring strip not only on edges and/or on the frame of the upholstered furniture, but also to implement one at least detachable fastening on the edges and/or on the frame via the fastener. Thus the fasteners can be caps for detachable fastening on the edges and/or on the frame.

Even if it is a good idea for the length of the spring strip to correspond essentially to the width of the cushion or the mattress, in certain embodiments it can also be possible for the length of the spring strip to be reduced compared to the width of the mattress or the cushion. But the length of the spring strip should be at least 80% of the width of the back side of the cover and/or of the mattress/cushion. In any case the length of the spring strip should be greater than the clear distance of the edges and/or of the frame of the furniture foundation on which the mattress is placed for use.

Instead of the above described embodiment, in which the two fastening strips are arranged on the edge side, but are spaced apart from the outer longitudinal edge of the back side, in one alternative embodiment it is provided that at least one of the strips, but preferably both strips, are located on the back of the cover on the longitudinal edge side, therefore directly on the longitudinal edge, the pocket receiver then being closed on the end side to thus point the receiving openings on the opposite fastening strips ultimately at one another. While in the above described embodiment the spring strip is located frictionally-engaged in the pocket receivers, in the other embodiment there is ultimately a positive and/or captive arrangement of the spring strip in the pocket receivers which are closed on the end side. In both cases it is however easily possible to insert the spring strips into the receiving device. In the above described embodiment this takes place either by pushing the spring strips into the respective through openings of the pocket receivers or by insertion into the pocket receivers which are closed on the end side; this is easily possible due to the elasticity of the core of the mattress or of the cushion.

In one alternative configuration of the pocket arrangement, a single fastening strip extends at least essentially over the length of the back side and is permanently joined to the back side via a plurality of connecting sites. The width of this fastening strip is at least 30% of the width of the back side. In particular, the width of the fastening strip corresponds at least essentially to the width of the back side. Finally, the pocket arrangement then extends over the entire back side of the cover and thus of the mattress and/or the cushion, wherein it conventionally has an essentially rectangular shape. In this embodiment there is one connection-free segment for forming a pocket between adjacent connecting sites. In this embodiment the pockets can also each have one through opening or can be closable or closed on at least one or even both ends. In any case it is preferable if the spring strips of the pocket arrangement can be removed so that if necessary a cover can also be removed from a mattress or a cushion and for example cleaned.

Regardless of the type of execution of the pocket arrangement with one or a plurality of fastening strips, it is such that the adjacent pockets run at least essentially parallel to one another. Moreover, adjacent pockets can also be spaced apart from one another over at least one tenth of the pocket width. The spacing of the individual pockets ultimately yields defined intermediate spaces between the spring strips for aeration and ventilation.

Another advantage in conjunction with the spring strips in accordance with the invention is that the same pocket arrangement with corresponding pocket execution can also always be used for spring strips with different strengths. Based on the material combination of the fiber core in accordance with the invention with the surrounding jacket matrix different elasticity stages of the spring strip can be ensured with a uniform external geometry of the spring strip. If for example relatively high strengths are necessary, a thicker fiber core and/or a fiber core with another cross sectional shape is used, while the surrounding jacket material is necessarily thinner. In terms of the outside dimensions in this case there is no difference from a spring strip in which a thinner fiber core and a thicker jacket are used. Thus, in the bottom spring cushioning in accordance with the invention spring strips with different elasticity stages can be provided. Furthermore, in the regions in which high loads occur, the intervals of adjacent pockets can also be reduced. Both measures for themselves or in combination are possible in order to be able to accommodate high loads in certain regions.

In the spring strip in accordance with the invention, it is such that it can be produced very easily and economically. Since preliminary curvatures or pretensionings are not necessary, for different widths of the cover and/or of the mattress or of the cushion required lengths of the spring strip can be easily produced, for example by cutting to the necessary spring strip length from an (endless) strand which is produced, for example, by pultrusion.

In one preferred configuration of the invention, the spring strip is mirror-symmetrical around a side center axis placed in the cross section through the jacket side and/or around a core center axis which is placed through the core and which runs perpendicular to the center axis of the side.

In conjunction with the spring strips, it is preferred that the jacket sides are made undulatory or ribbed on the outside with grooves which extend in the spring strips in the longitudinal direction in order to prevent slipping of the spring strip in the pockets transversely to the longitudinal direction of the spring strip. With respect to the above described symmetry, the undulatory or ribbed configuration is preferably both on the top and also on the bottom of the jacket side.

Moreover, this invention also relates to a piece of furniture, in particular upholstered furniture, with a furniture foundation and at least one mattress and/or at least one cushion of the aforementioned type. The furniture in accordance with the invention can be in particular sitting furniture and/or reclining furniture.

Other features, advantages and possible applications of this invention will become apparent from the following description of exemplary embodiments with reference to the accompanying drawings and the drawings themselves. Here all described and/or illustrated features for themselves or in any combination form the subject matter of this invention.

DETAILED DESCRIPTION OF THE INVENTION

Figure 1:
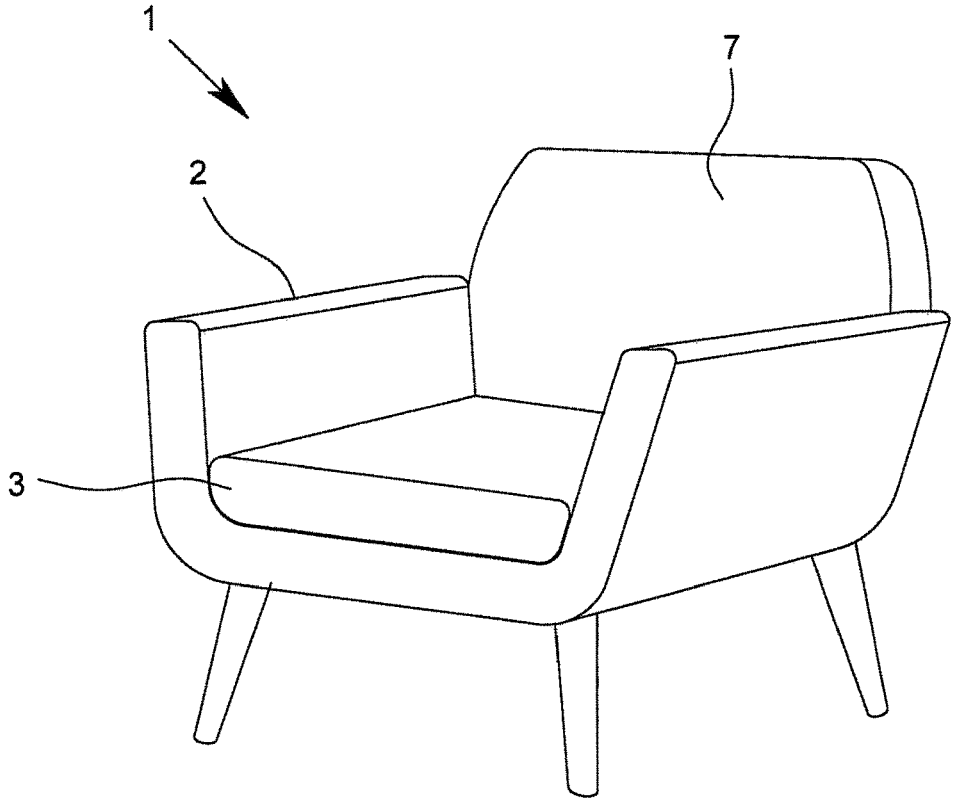
FIG. 1 is, a perspective view of a piece of furniture in accordance with the invention in the form of an armchair.

FIG. 1 shows a piece of furniture 1 which in this case is an armchair. The piece of furniture 1 has a furniture foundation 2 and a cushion 3 which is placed on the furniture foundation 2. Edges on the furniture foundation 2 onto which the cushion 3 is placed are not shown here. The cushion 3 can be removed from the furniture foundation 2.

Figure 2:
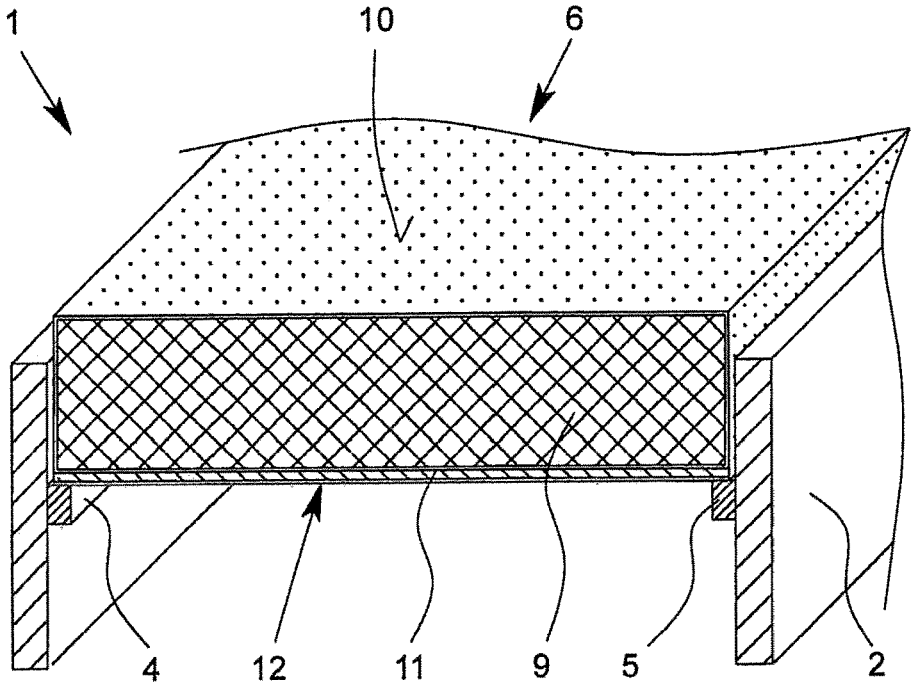
FIG. 2 is a perspective cross sectional view of another piece of furniture in accordance with the invention in the form of a bed.

FIG. 2 schematically shows a bed as a piece of furniture 1. The bed likewise has a furniture foundation 2 in the form of a frame, there being edges 4, 5 on the sides of the furniture foundation 2 which are opposite one another. A mattress 6 is placed on the edges 4, 5.

The edge and/or frame arrangement which is not shown for the piece of furniture 1 shown in FIG. 1 corresponds fundamentally to the edge and/or frame arrangement shown in FIG. 2, and the edges 4, 5 in the embodiment shown in FIG. 1 can run both parallel and also transversely to the backrest 7 of the furniture foundation 2.

FIGS. 3 to 10 show different embodiments of a mattress 6. The following statements on the mattress 6 as is shown by way of example in FIG. 11, relate in the same manner to the cushion 3, described above.

The mattress 6 has a cover 8 and an elastic core 9 which is accommodated in the cover 8. The core 9 is in particular a foam core of any foam. But, other elastic materials can be used as the core material of the mattress 6 are possible. The core 9 has an essentially cuboidal body shape and the cover 8 which has been slipped onto the core 9 corresponds in terms of its cover interior at least essentially the shape of the core 9. The cover 8 has a utilized side 10 as a top side or outer side which is conventionally facing the user when being used. When being used, the user ultimately sits or lies on the utilized side. Furthermore, the cover 8 on the side opposite the utilized side 10 has a back side 11. The back side 11 faces away from the user when it is being used.

At this point it is important in this invention that on the back side 11 of the cover 8 there is a receiving device for bottom spring cushioning 12. The receiving device is located on the outer side of the back side 11, therefore is accessible from the bottom of the mattress 6. The receiving device which is provided on the outer side of the back side 11 is made as a pocket arrangement 13 with a plurality of pockets 14. The pockets 14 are each made for accommodating and arranging the spring strips 15, as follows from the figures there being one spring strip 15 per pocket 14. By the spring strips 15 the bottom spring cushioning 12 is ultimately made as a lath grid which is connected to the cover 8 and thus is integrated into the mattress 6. The individual spring strips 15 run parallel to one another and transversely to the longitudinal axis L of the mattress 6.

In the illustrated embodiments, the bottom spring cushioning 12 which is integrated into the cover 8 has ten spring strips 15 at a time. All spring strips 15 have the same hardness and/or stiffness. It is also possible though for there to be different spring strips 15. Thus for example in the middle region of the mattress 6 there can be harder and/or stiffer spring strips 15, while at the head and/or foot end of the mattress 6 there can be rather softer, less stiff spring strips 15. It goes without saying that the number of spring strips 15 of the bottom spring cushioning 12 can fundamentally vary. While the spring strips 15 in the illustrated embodiments are each spaced uniformly apart, there can fundamentally also be a difference spacing between individual spring strips 15.

Figure 12:
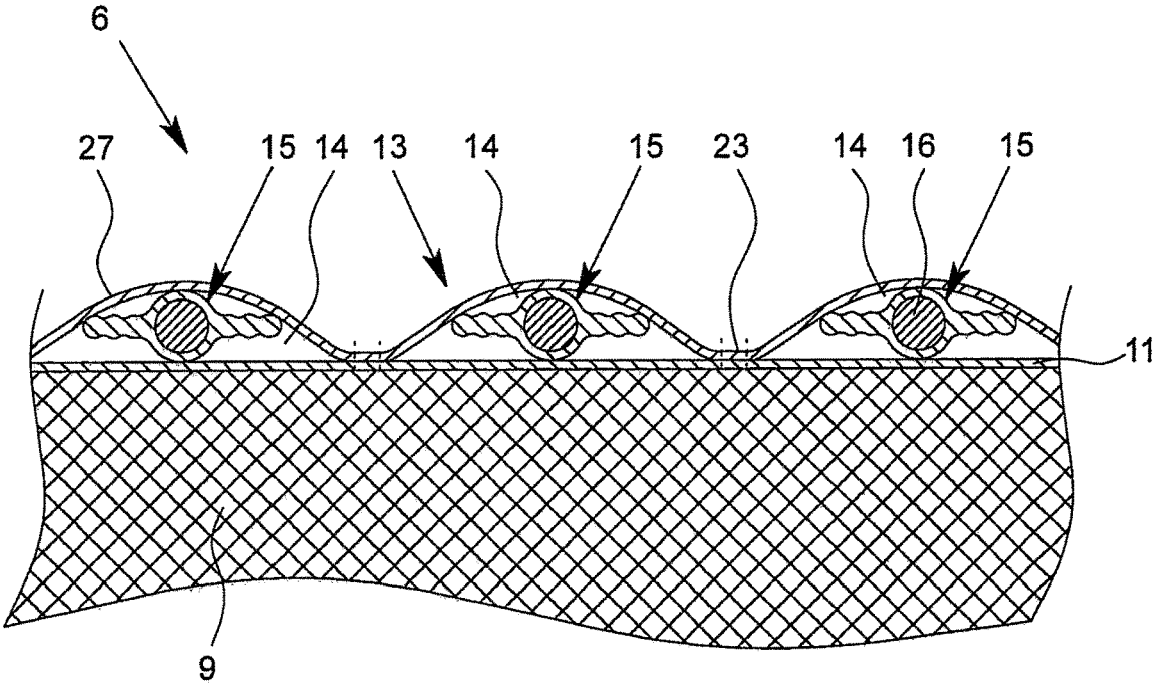
FIG. 12 is a sectional view of part of the cushion shown in FIG. 11.

As follows in particular from the detailed representations according to FIGS. 4, 6, 8 and 10 and otherwise from FIG. 12, the spring strips 15 are located in the pockets 14 with little play in the direction of the longitudinal axis L. Implementing little play of the spring strips in the respective pockets 14 makes it possible for the spring strips 15 to be able to move to a limited degree even under load. Preferably the play of the spring strips 15 in the pockets 14 is between 0.1 to 1.0 times the width of the spring strip 15. In particular, the play is between 0.2 to 0.5 times the width of the spring strip.

In the illustrated exemplary embodiments, all spring strips 15 of the bottom spring cushioning 12 are made structurally identical. In this respect, reference is made in particular to FIGS. 13 and 14. Each of the spring strips 15 has a fiber core 16 of glass fibers or GFK, therefore glass fiber-reinforced plastic, and a jacket 17 of thermoplastic material which surrounds the fiber core 16. The jacket 17 consists of polypropylene here. The jacket 17 is ring-shaped based on the fiber core 16 which is circular here. One jacket side 18 at a time sticks out on opposite sides of the jacket 17. The jacket sides 18 which are joined to the jacket 17 as a result lead to an enlarged support surface of the spring strips 15.

The jacket sides 18 preferably have a length which is equal than or greater to the diameter of the fiber core 16. Conversely, the maximum thickness of the jacket side 18 is less than half the diameter of the fiber core 16. The relatively narrow, elongated jacket sides 18 which extend ultimately over the entire length of the spring strip 15 yields only a relative low material demand in a relatively wide bearing surface.

Figure 13:
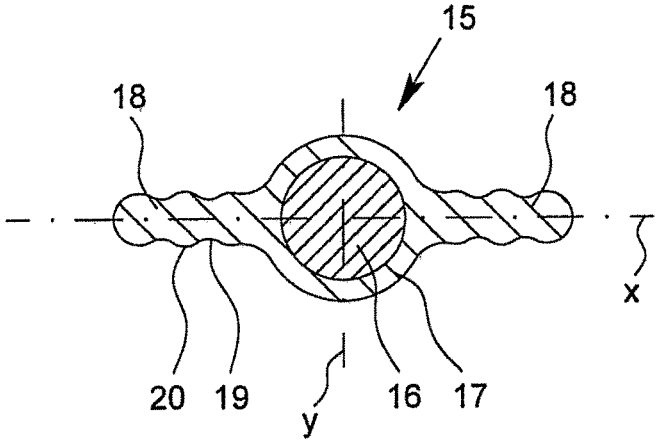
FIG. 13 is a schematic cross sectional view of a spring strip.

In addition, FIG. 13 illustrates that the spring strip 15, viewed in cross section, is mirror-symmetrical around a center axis x of the side placed through the jacket sides 18 and around a center axis y of the core which is placed through the fiber core 16 and which runs perpendicular to the center axis x of the side. This symmetry simplifies the insertion of the spring strips 15 into the pockets 14 of the pocket arrangement 13 since a certain alignment of the spring strips 15 need not be observed when being inserted into the pockets 14 of the pocket arrangement 13.

Figure 14:
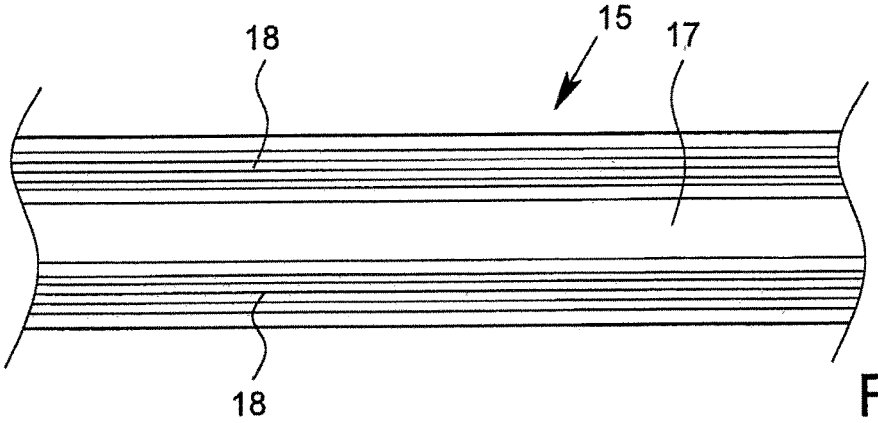
FIG. 14 is a top view of the spring strip from FIG. 13.

Furthermore, FIGS. 13 and 14 show that the jacket sides 18 are made undulatory on the top and bottom with grooves 19 and projections 20 which extend in the longitudinal in spring strip direction.

Figures 3, 4:
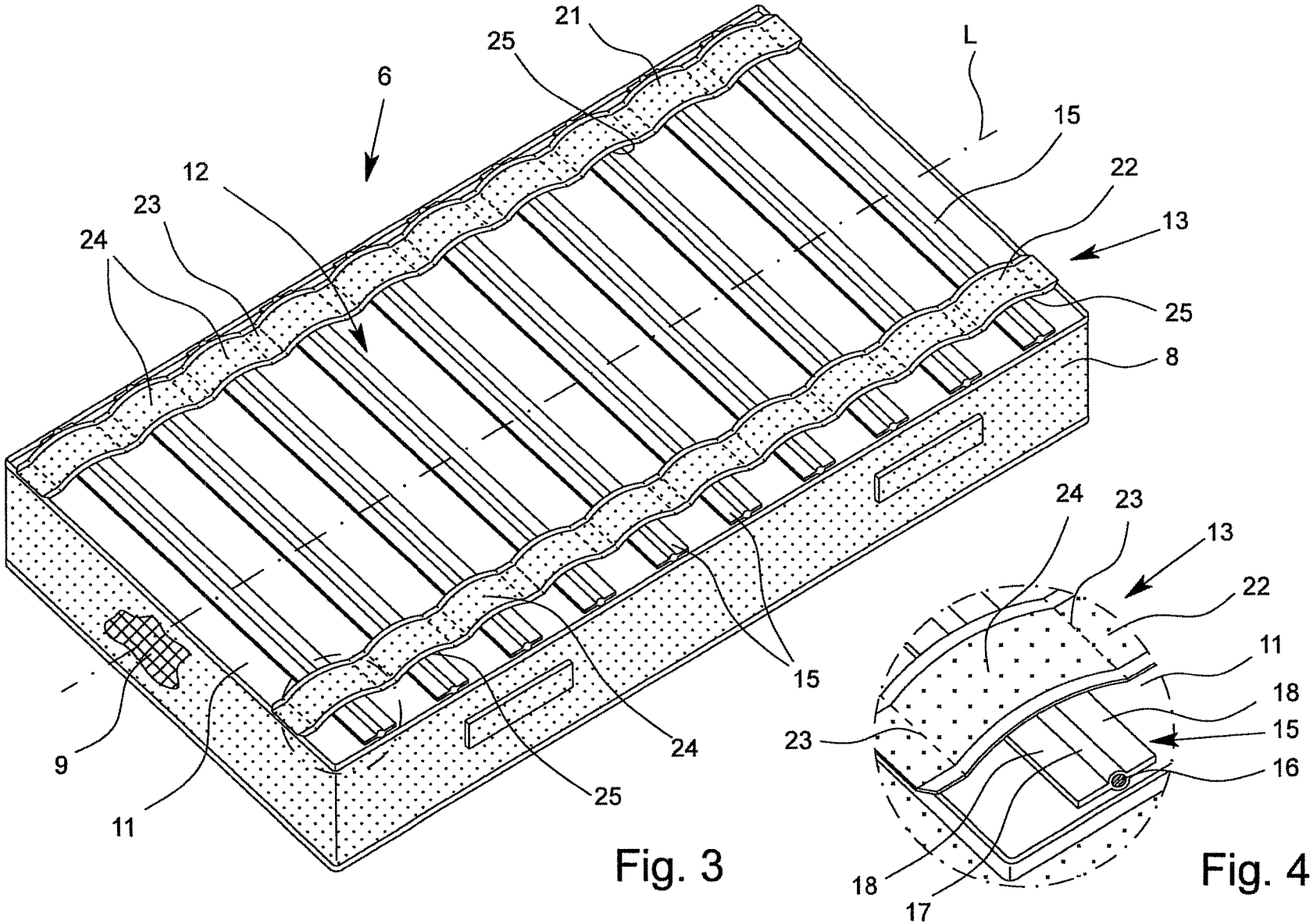
FIG. 3 is a perspective bottom view of a mattress in accordance with the invention with the cover partially broken away.
FIG. 4 is a view of a detail of the mattress from FIG. 3.
Figures 5, 6:
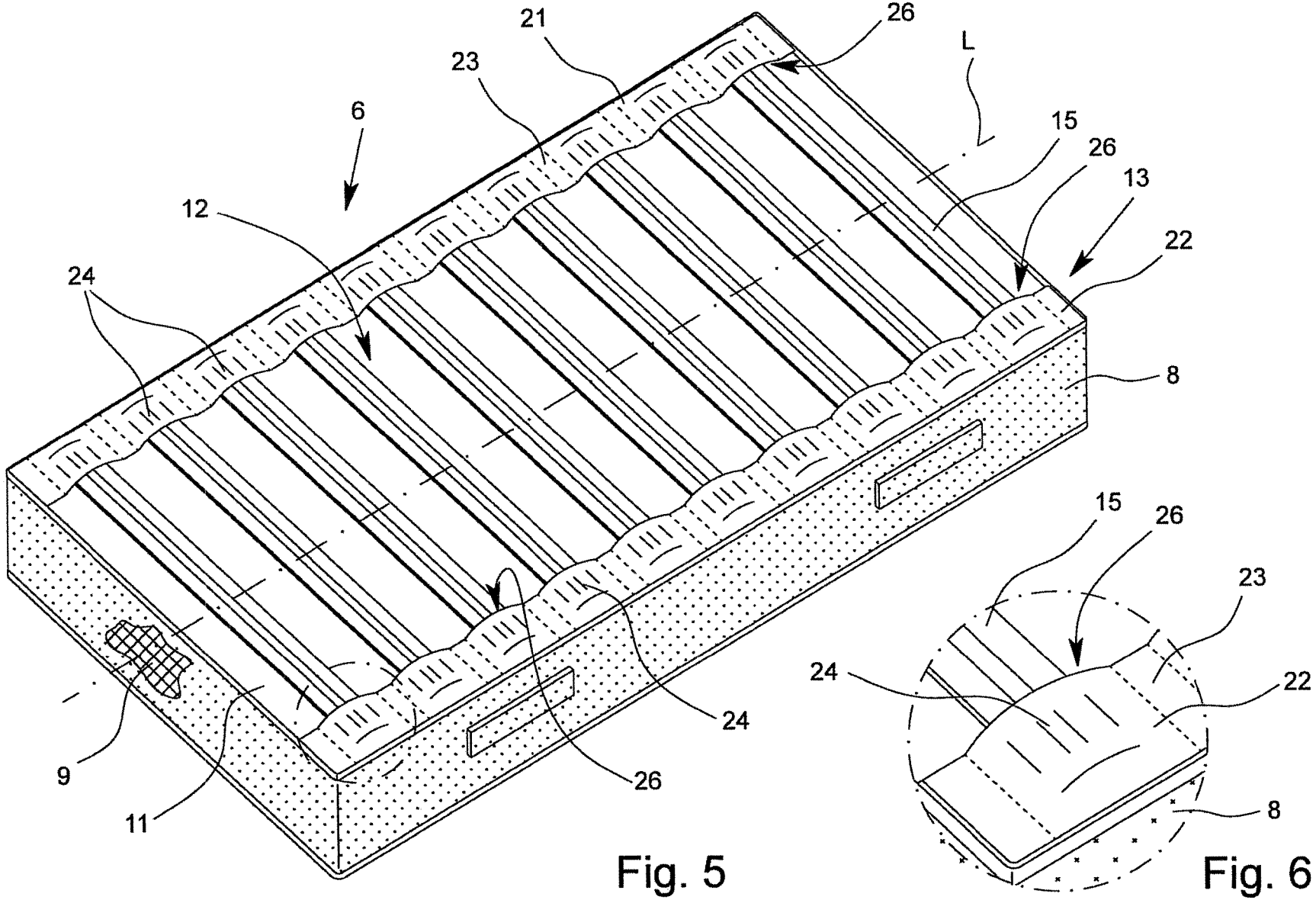
FIG. 5 is a bottom view of another embodiment of a mattress in accordance with the invention with the cover partially broken away.
FIG. 6 shows a detail of the mattress from—FIG. 5.
Figure 9:
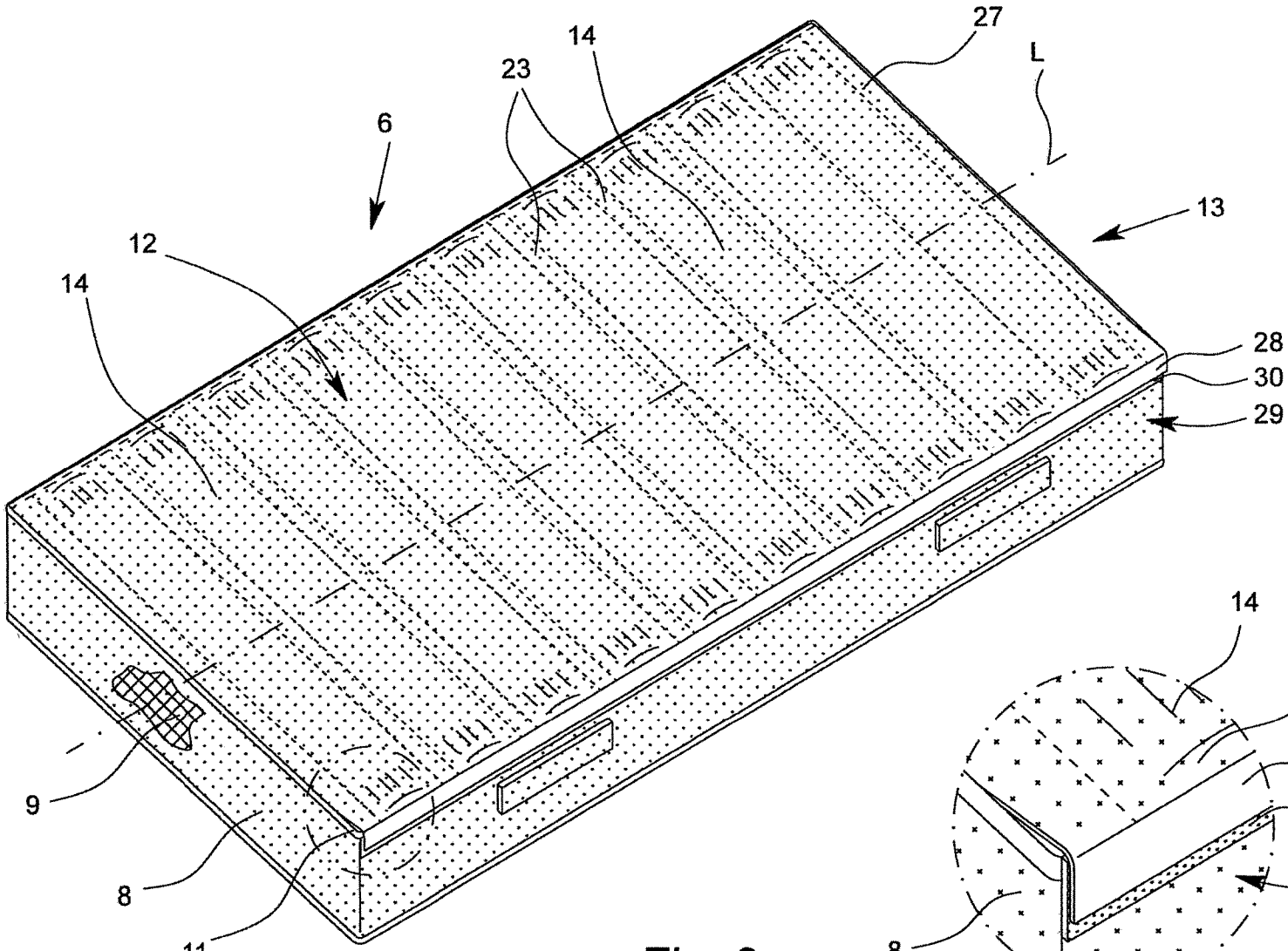
FIG. 9 is a bottom view of another embodiment of a mattress in accordance with the invention with the cover partially broken away.

As follows from the individual embodiments of the mattress 6, the length of the spring strips 15 corresponds at least essentially to the width of the mattress 6 and/or the back side 11 of the cover 8. In the embodiments which are shown in FIGS. 3 and 5 and in which the pockets 14 are open on the end side, the spring strips 15 can be somewhat longer than in the embodiments which are shown in FIGS. 5 and 9 and in which the pockets 14 are closed on the end side. In the embodiment with opened pockets 14, the length of the spring strips 15 can correspond roughly to the width of the mattress 6 and/or can be slightly smaller, namely between 1% to 5%. For pockets 14 which are closed on the end side there is a length of the spring strips 15 which has been reduced generally between 1% to 20% with reference to the width of the mattress 6 and/or of the back side 11 of the cover 8. In all cases, it is however such that the length of the spring strips 15 is always greater than the clear distance of the edges and/or the frame 4, 5 of the furniture foundation 2.

In the embodiment which is shown in FIGS. 3 to 6, the pocket arrangement 13 has two attachment strips 21, 22 at a time which run parallel to one another and lengthwise to the longitudinal axis L of the cover 8 and which extend over the entire length of the back side 11. The fastening strips 21, 22 can fundamentally have the same distance to the longitudinal axis L, but also, as shown, they can be spaced at different distances away from it. The fastening strips 21, 22 are permanently connected to the back side 11 of the cover 8 via a plurality of connecting sites 23. Here the fastening strips 21, 22 are sewn to the back side 11, while cementing would also be fundamentally possible. Between adjacent connecting sites 23 there is one connection-free segment which forms a pocket receiver 24 of a pocket 14. For two fastening strips 21, 22 one pocket 14 is formed by two pocket receivers 24 which are opposite one another. Here an opposite arrangement means that the pocket receivers 24 which are assigned to one another lie on a transverse axis which runs at a right angle to the longitudinal axis L.

It goes without saying that instead of the illustrated embodiments with two fastening strips 21, 22, there can also be a larger number of such strips.

The pocket receiver 24 in the embodiment which is shown in FIGS. 3 and 4 has a through opening 25 for inserting a spring strip 15. In the embodiment which is shown in FIGS. 5 and 6 the pocket receiver 24 on the end side, namely towards the edge of the mattress 6 and/or towards the cover 8, is closed such that a receiving opening 26 results on the respective fastening strip 21, 22. The assigned receiving openings 26 each point in the direction of the other fastening strip.

FIGS. 7 to 10 show embodiments in which the pocket arrangement 13 has a single fastening strip 27 which extends at least essentially over the length of the back side 11 and which is permanently connected to the back side 11 via a plurality of connecting sites 23. In this embodiment the fastening strip 27 is also sewn to the back side 11. In the illustrated exemplary embodiments, the fastening strip 27 extends over the entire back. Between adjacent connecting sites 23 there is one connection-free segment at a time for forming the respective pockets 14.

Figures 7, 8:
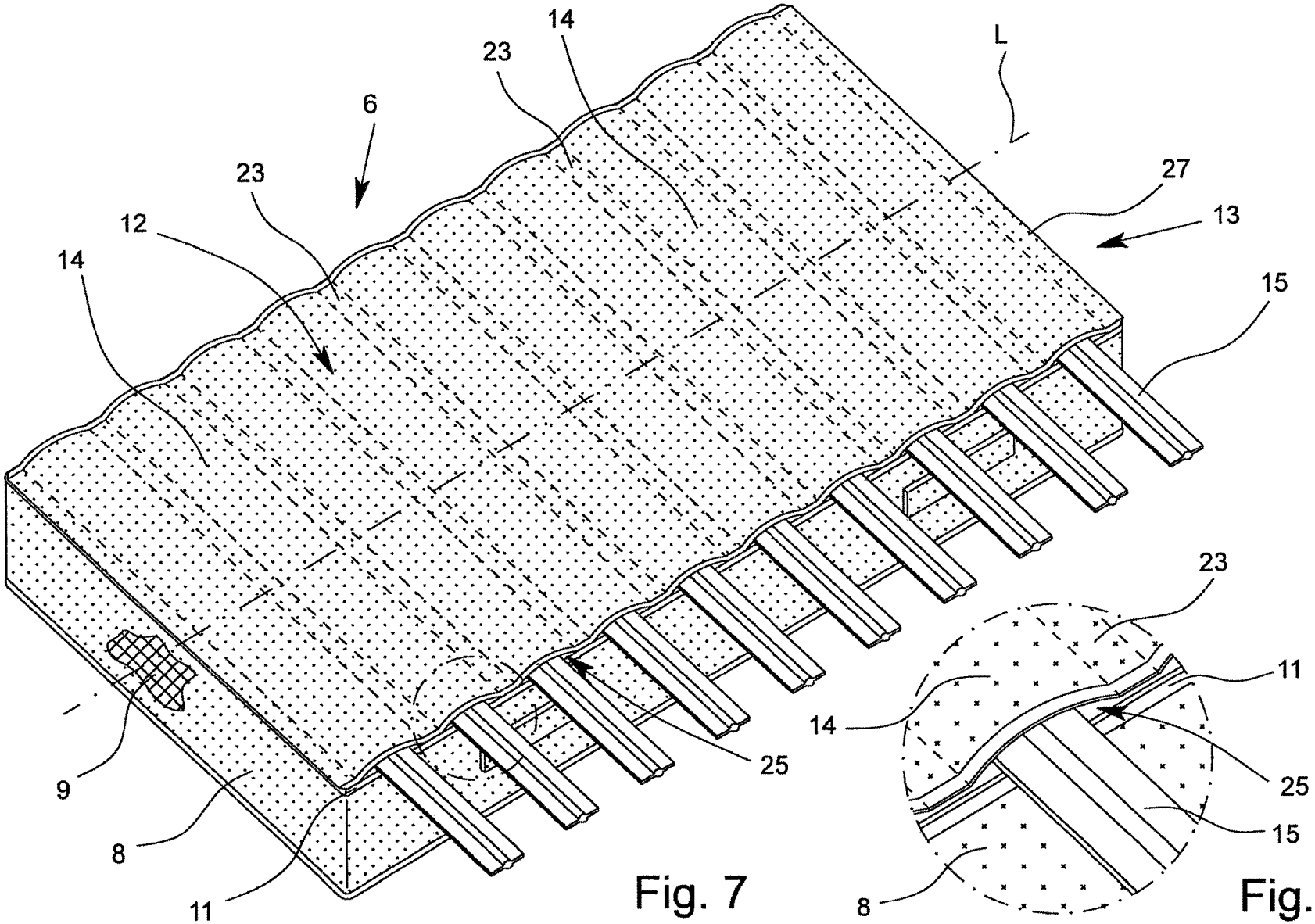
FIG. 7 is a bottom view of another embodiment of a mattress in accordance with the invention with the cover partially broken away.
FIG. 8 shows a detail of the mattress from FIG. 7.
Figure 10:
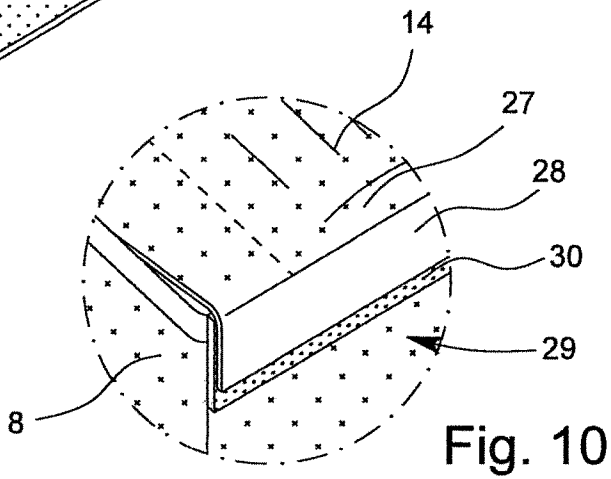
FIG. 10 is a view of a detail of the mattress from FIG. 9.

In the embodiments which are shown in FIGS. 7 and 8, each of the pockets 14 has a through opening 25. In the embodiment which is shown in FIGS. 9 and 10, the pockets 14 are closed on one end. The pockets 14 are openable on their other end. For this purpose, the fastening strip 27 has an edge strap 28 which can be attached on a longitudinal side 29 of the cover 8. The attachment can take place, for example, via a VELCRO® hook-and-loop connection 30.

It goes without saying that instead of a VELCRO® hook and loop connection there can also be other possibilities for closing of the end of the pockets 14. Thus, the pockets 14 can also be buttoned up on the end, and push-button, snap or zipper connections are also possible.

Figure 11:
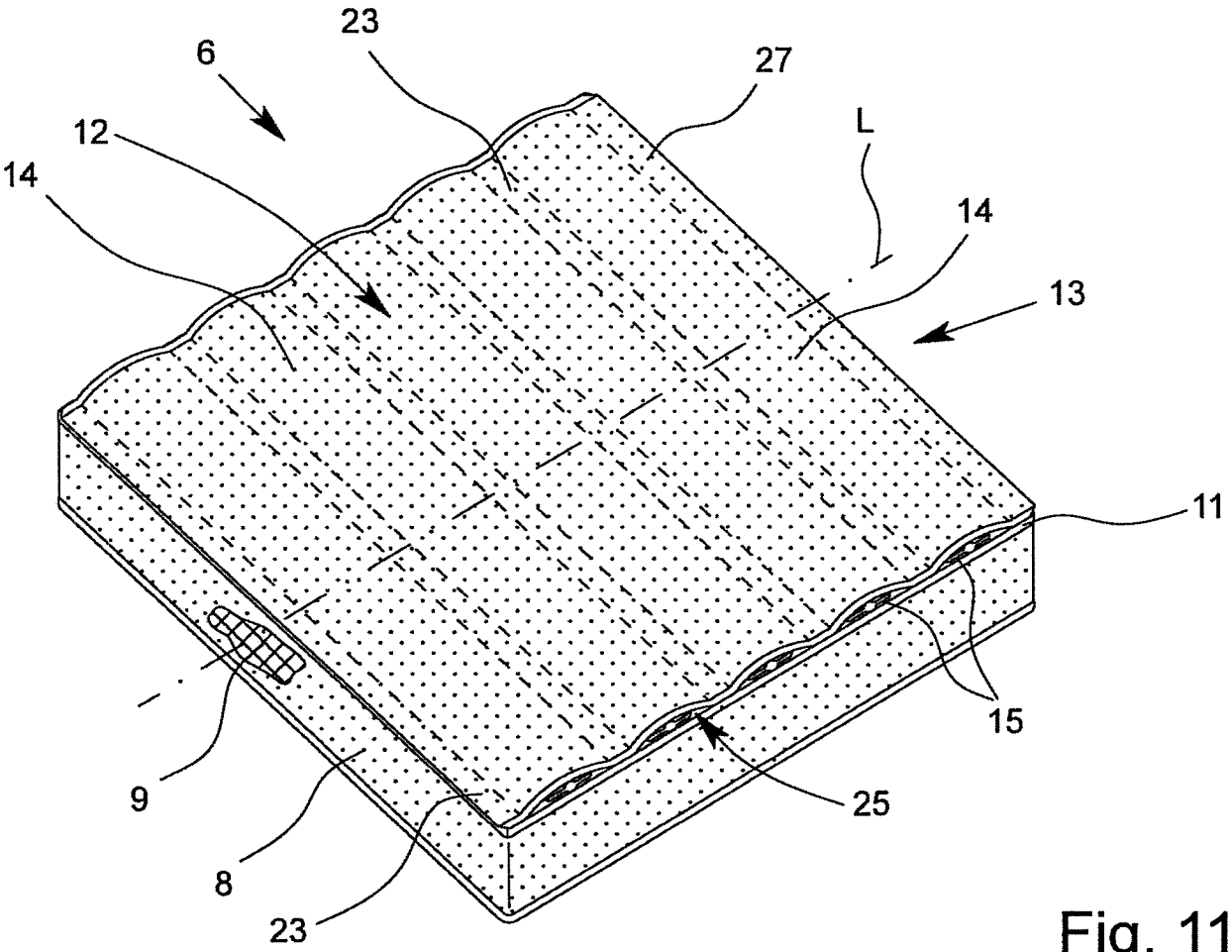
FIG. 11 is a bottom view of a cushion in accordance with the invention with the cover partially broken away.

In FIG. 11, a cushion 3 is shown schematically which corresponds in terms of its fundamental structure to the mattress 6. Differences consist solely in the dimensions compared to the mattress 6. The cushion 3, like the mattress 6, likewise has a cover 8 and a core 9 and is made in the same way as the above described mattress 6, also with respect to all described mattress-embodiments so that all preceding statements about the mattress 6 apply in the same way to the cushion 3.

After pulling the cover 8 over the core 9 of the cushion 3 or the mattress 6, depending on the embodiment the spring strips 15 are pushed into the pockets 14 and/or pocket receivers 24. In the embodiment according to FIG. 9, the pockets 14 are closed in conjunction with the VELCRO® hook and loop connection 30 after the spring strips 15 have been pushed through the edge strap 28. In the embodiment according to FIG. 5 the spring strips 15 with their one end are inserted into one pocket receiver 24, while the mattress 6 or the cushion 3 are then moved due to elasticity such that the other end of the spring strips 15 can likewise be inserted into the respectively opposite pocket receiver 24. This then yields a positive or fixed arrangement of the spring strips 15 in the individual pockets 14.

It is not shown that a mattress 6 or also a cushion 3, in particular in the vacuumed state, together with the bottom spring cushioning 12, therefore together with the spring strips 15 which have been provided on the cover 8, can be made rollable.

Figure 15:
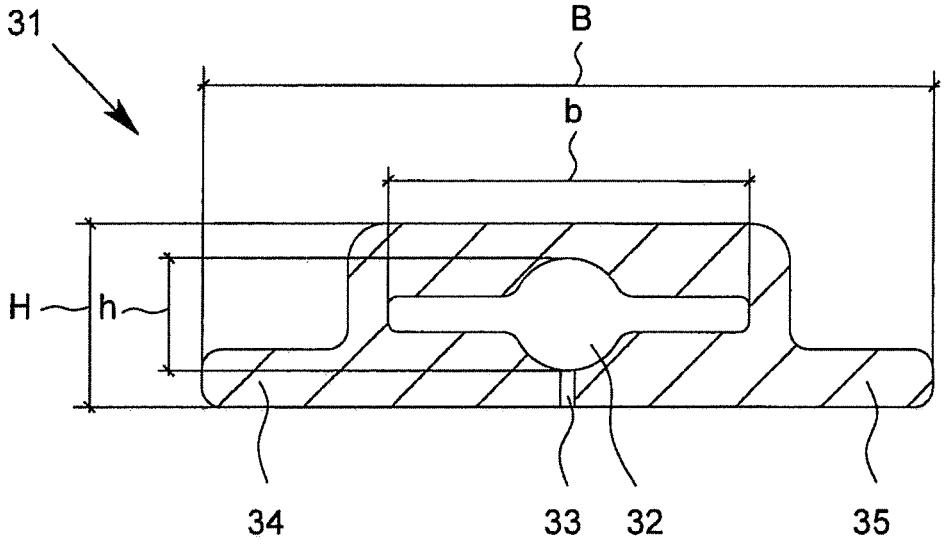
FIG. 15 is a view of a casing for a spring strip of the cover in accordance with the invention.

FIG. 15 shows a casing 31 for a spring strip 15. The casing 31 at least essentially surrounds the spring strip 15. In the casing 31 there is a recess 32 which in terms of its external shape constitutes a negative of the cross section of the spring strip 15. This means that the recess 32 in terms of its dimensions corresponds at least essentially to the dimensions of the width and height of the spring strip 15. The recess 32 is accessible via a slit 33. The length of the casing 31 corresponds at least essentially to the length of the spring strip 15. If necessary, the casing 31 can be somewhat longer than the spring strip 15 so that the face-side ends of the spring strip 15 ultimately do not project on the face side over the casing 31. Preferably, the spring strip 15 in terms of length is somewhat smaller, specifically between 0 to 1 cm, than the length of the casing 31. Conversely, the height H and the width B of the casing 31 are each greater by a factor of 1.1 to 3.0 than the corresponding height h and/or width b of the spring strip 15. Ultimately, by this configuration the spring strip 15 is completely surrounded by the material of the casing 31 except for the slit 33 which extends in particular over the entire length of the casing 31.

The casing 31 itself is made of an elastic foam which can be compressed. The dimensions of the casing 31 are geared to the volume of the pocket 14 so that the spring strip 15 with the surrounding casing 31 at least essentially fills the pocket 14 after inserting the spring strip 15. In this way not only is the spring strip 15 prevented from moving back and forth in the pocket 14, but chafing of the edges of the spring strip 15 on the material of the pocket 14 is also avoided.

Figure 16:
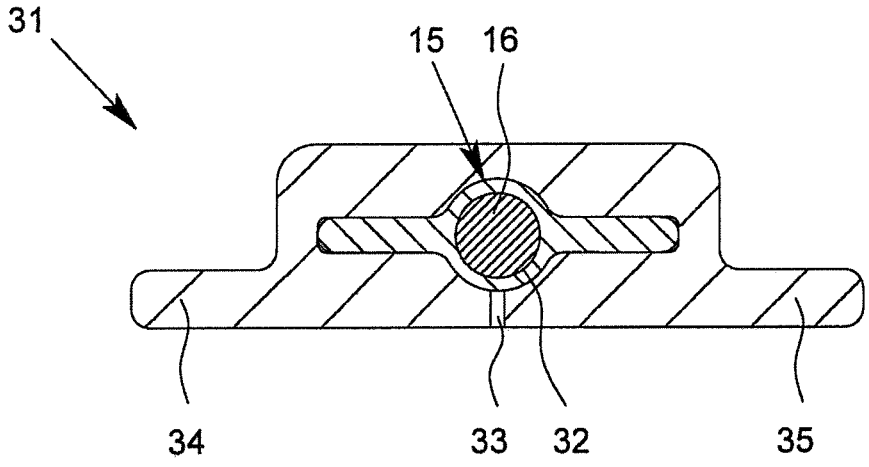
FIG. 16 is a representation of the casing with the spring strip of FIG. 15 inserted.

In the embodiment which is shown in FIG. 15, the casing 31 is produced as a separate body with the insertion slit 33. For insertion of the spring strip 15 the casing 31 on its lateral sides 34, 35 is turned up so that insertion of the spring strip 15 is possible. FIG. 16 shows the inserted state.

Figure 17:
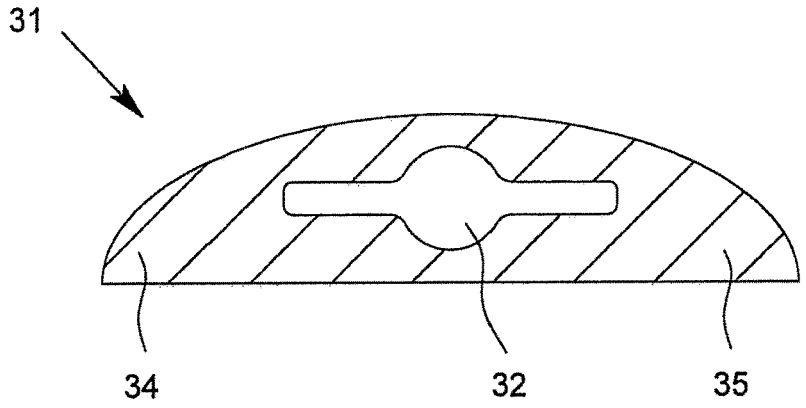
FIG. 17 shows a view of another embodiment of a casing without the spring strip corresponding to FIG. 15, FIG. 18 a view of the casing with the spring strip of FIG. 17 inserted, FIG. 19 a view of a cover in accordance with the invention with a mattress with inserted spring strips which are surrounded by a casing.
Figure 18:
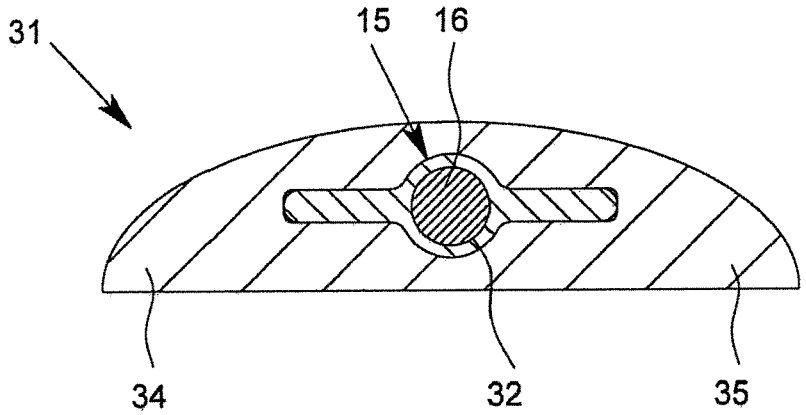
Figure 19:
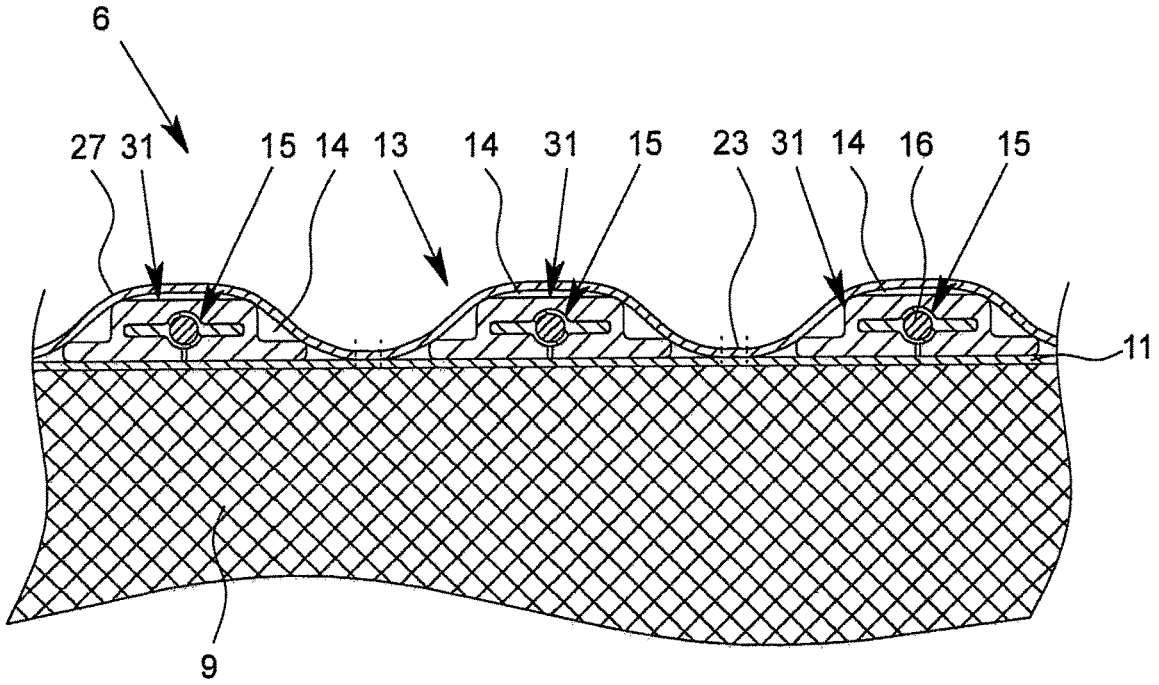

In FIG. 17, one embodiment is shown in which the casing 31 has a semielliptical shape. In this embodiment, the casing 31 is likewise produced as a foamed body from an elastic, compressible foam into which the spring strip 15 is pushed. FIG. 19 shows the inserted state. But, it is also fundamentally possible to foam-in the spring strip 15, in particular, immediately after its manufacture, i.e., as an endless strand or also as a finished spring strip which has been cut off from the endless strand so that, subsequently, the state shown in FIG. 19 results. It goes without saying that there can fundamentally be one slit in the casing 31 which is shown in FIG. 18.

The illustrated casings 31 are mirror-symmetrical with respect to the center axis y of the core in both embodiments. But it is also fundamentally possible to choose a symmetrical shape in which there is also symmetry with respect to the center axis x of the side. In this case the sides 34, 35 would then be symmetrical to the foundation of the casing in both embodiments.

Figures 20, 21:
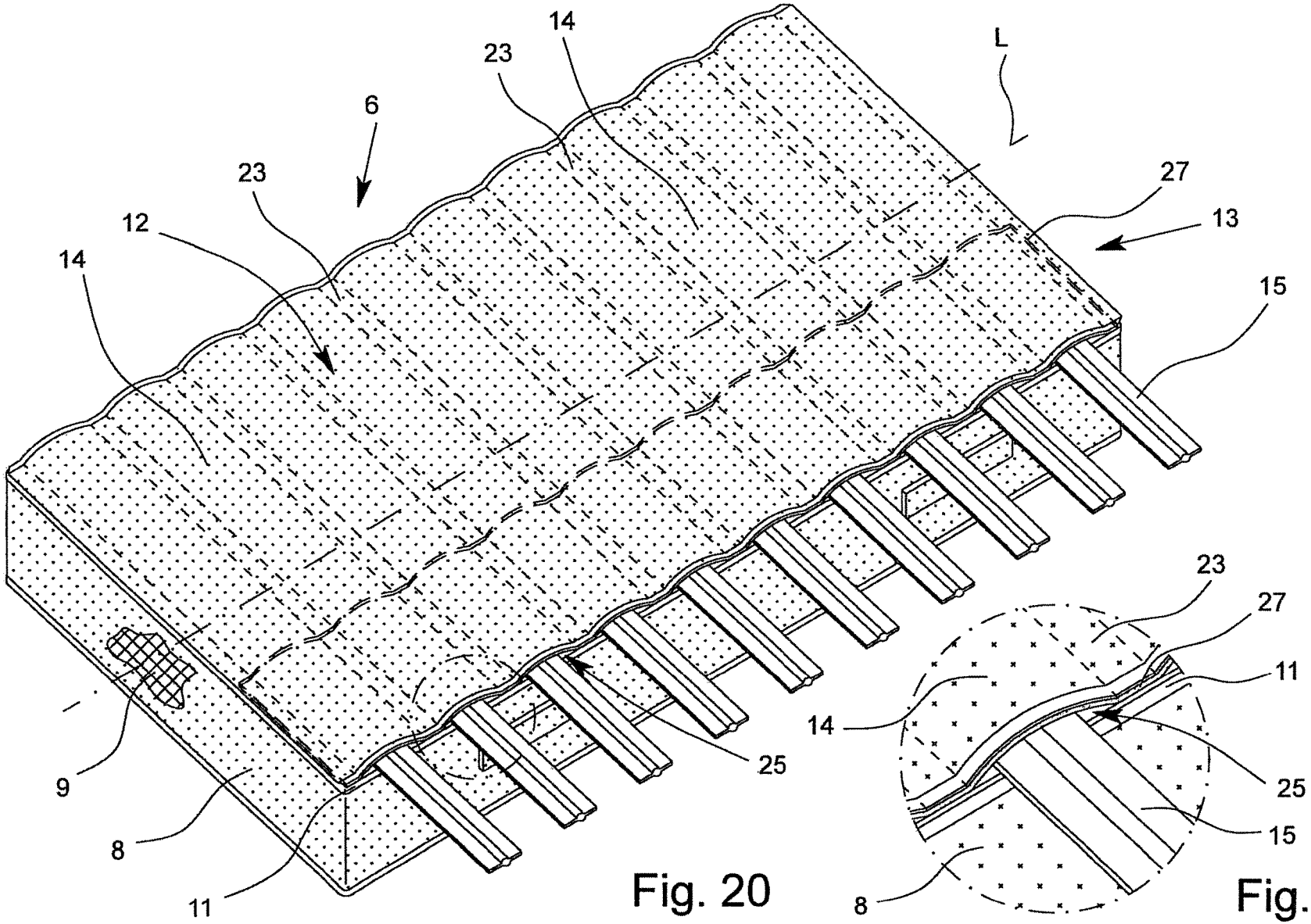
FIG. 20 is a perspective view of a cushion with spring strips received in pockets.
FIG. 21 is an enlarged detail of the area of one of the spring strips shown in FIG. 20.

FIGS. 20 and 21 show an alternative to arrangement described about related to FIGS. 7 & 8 in which a single fastening strip 27 extends at least essentially over the length of the back side and is permanently joined to the back side via a plurality of connecting sites 23. The width of this fastening strip is at least 30% of the width of the back side. In particular, the width of the fastening strip corresponds at least essentially to the width of the back side. Finally, the arrangement of the pockets 14 then extends over the entire back side of the cover and thus of the mattress 6 and/or the cushion 3, wherein it conventionally has an essentially rectangular shape. In this embodiment, there is a connection-free segment for forming a pocket 14 between adjacent connecting sites 23. In this embodiment, each of the pockets can also have a through opening or can be closable or closed on at least one or even both ends. In any case, it is preferable if the spring strips 15 of the pocket arrangement can be removed so that, if necessary, cover 8 can also be removed from a mattress or a cushion and, for example, cleaned.

What is claimed is:

1. A cover for a furniture mattress or cushion, comprising:

a utilized side and a back side, wherein on the back side there is a receiving device, a bottom spring cushioning having spring strips, at least one spring strip of which is made of a fiber-reinforced plastic material with a fiber core and a plastic jacket which surrounds the fiber core, a jacket side sticking out from each of opposite sides of the jacket for providing an enlarged support surface of the spring strip, wherein bottom spring cushioning is held by the receiving device, wherein the spring strip is mirror-symmetrical around a center axis extending through both of the jacket sides and the core, wherein the jacket sides have a length which is greater than or equal to a diameter of the fiber core, and wherein the jacket sides have a maximum thickness that is less than half a diameter of the fiber core.

2. The cover as claimed in claim 1, wherein the jacket sides extend over essentially the entire length of the spring strip.

3. The cover as claimed in claim 1, wherein the jacket side is strip-shaped with a thickness which is essentially constant in a width direction.

4. The cover as claimed in claim 1, wherein the receiving device is on an outer side of the backside.

5. The cover as claimed in claim 1, wherein the receiving device has a pocket arrangement with a plurality of pockets for arranging the spring strips.

6. The cover as claimed in claim 5, wherein there is one spring strip per pocket.

7. The cover as claimed in claim 5, wherein the pocket arrangement has at least two fastening strips which extend at least essentially over the length of the back side, which run parallel to one another, and which are each permanently joined on the back side via a plurality of connecting sites, between adjacent connecting sites there being a respective connection-free segment for forming a pocket receiver of a pocket.

8. The cover as claimed in claim 1, wherein the receiving device comprises at least one pocket receiver that has a through opening for insertion of a respective one of the spring strips.

9. The cover as claimed in claim 1, wherein the receiving device comprises a pair of pocket receivers, each of which is closed on one end and has a receiving opening on an opposite end, the receiving opening of one of the pocket receivers faces the receiving opening of the other of the pocket receivers.

10. The cover as claimed in claim 1, wherein, the pocket arrangement has a single fastening strip which extends at least essentially over the length of the back side and which is permanently joined to the back side via a plurality of connecting sites and whose width corresponds to at least 30% of the width of the back side, between adjacent connecting sites there being a respective connection-free segment for forming a pocket having an opening for insertion of a spring strip.

11. The cover as claimed in cover as claimed in claim 10, wherein the pocket is closed or closable on at least one end.

12. A mattress or cushion, with a cover and an elastic core which is accommodated in the cover, the cover comprising a utilized side and a back side, wherein on the back side there is a receiving device, a bottom spring cushioning having spring strips, at least one spring strip of which is made of a fiber-reinforced plastic material with a fiber core and a plastic jacket which surrounds the fiber core, a jacket side sticking out from each of opposite sides of the jacket for providing an enlarged support surface of the spring strip, wherein bottom spring cushioning is held by the receiving device, wherein the spring strip is mirror-symmetrical around a center axis extending through both of the jacket sides and the core, wherein the jacket sides have a length which is greater than or equal to a diameter of the fiber core, and wherein the jacket sides have a maximum thickness that is less than half a diameter of the fiber core.

13. The mattress or cushion as claimed in claim 12, wherein on the back side of the cover there is bottom spring cushioning with a plurality of said spring strips with the spring strips running parallel to one another.

14. The mattress or cushion as claimed in claim 13, wherein the bottom spring cushioning is in the form of a lath grid.

15. The mattress or cushion as claimed in claim 12, wherein the receiving device has a pocket arrangement with a plurality of pockets for arranging the spring strips, and wherein each spring strip is held by frictional resistance in a respective one of the pockets.

16. The mattress or cushion as claimed in claim 12, wherein the spring strips have a length that extends over at least 80% of a width of the back side of the cover.

17. The mattress or cushion as claimed in claim 12, wherein the mattress or the cushion together with the bottom spring cushioning is rollable.

18. A piece of furniture, comprising: a furniture foundation, a mattress or a cushion on the furniture foundation, the mattress or cushion having a cover and an elastic core which is accommodated in the cover, the cover comprising a utilized side and a back side, wherein on the back side there is a receiving device, a bottom spring cushioning having spring strips, at least one spring strip of which is made of a fiber-reinforced plastic material with a fiber core and a plastic jacket which surrounds the fiber core, a jacket side sticking out from each of opposite sides of the jacket for providing an enlarged support surface of the spring strip wherein bottom spring cushioning is held by the receiving device, wherein the spring strip is mirror-symmetrical around a center axis extending through both of the jacket sides and the core, wherein the jacket sides have a length which is greater than or equal to a diameter of the fiber core, and wherein the jacket sides have a maximum thickness that is less than half a diameter of the fiber core.

* * * * *